US010655312B1

(12) United States Patent
Lee

(10) Patent No.: US 10,655,312 B1
(45) Date of Patent: May 19, 2020

(54) AUTOMATIC TOILET PLUNGER

(71) Applicant: Michael Lee, University Place, WA (US)

(72) Inventor: Michael Lee, University Place, WA (US)

( * ) Notice: Subject to any disclaimer, the term of this patent is extended or adjusted under 35 U.S.C. 154(b) by 0 days.

(21) Appl. No.: 16/184,128

(22) Filed: Nov. 8, 2018

(51) Int. Cl.
*E03C 1/308* (2006.01)

(52) U.S. Cl.
CPC ..... *E03C 1/308* (2013.01)

(58) Field of Classification Search
CPC ..... E03C 1/308
USPC ..... 4/255.1
See application file for complete search history.

(56) References Cited

U.S. PATENT DOCUMENTS

| | | | |
|---|---|---|---|
| 4,445,236 | A | 5/1984 | Nadolny |
| 6,922,854 | B2 | 8/2005 | Allenbaugh |
| 8,209,790 | B1 | 7/2012 | Garry |
| D810,367 | S | 2/2018 | Hickerson |
| 2012/0247519 | A1 | 10/2012 | Dondurur |
| 2014/0298579 | A1 | 10/2014 | Nowak |
| 2015/0247309 | A1 | 9/2015 | Bugni |

FOREIGN PATENT DOCUMENTS

| | | |
|---|---|---|
| WO | WO2004009917 | 1/2004 |

*Primary Examiner* — Lori L Baker

(57) ABSTRACT

An automatic toilet plunger includes a plunger body having a top end, a bottom end, and an inside. The plunger body is hollow and cylindrical. A plunger head is coupled to the bottom end of the plunger body. A plunging mechanism is coupled inside the plunger body of the plunger. The plunging mechanism is in operational communication with the plunger head and is configured to cause the plunger head to clear a toilet. A plurality of controls is coupled to the plunger body and is in operational communication with the plunging mechanism. A power source is coupled to the plunger body and is in operational communication with, and provides power to, the plunging mechanism.

7 Claims, 4 Drawing Sheets

AUTOMATIC TOILET PLUNGER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to automatic toilet plungers and more particularly pertains to a new automatic toilet plunger for an enhancing a toiler plunger.

BRIEF SUMMARY OF THE INVENTION

An embodiment of the disclosure meets the needs presented above by generally comprising a plunger body having a top end, a bottom end, and an inside. The plunger body is hollow and cylindrical. A plunger head is coupled to the bottom end of the plunger body. A plunging means is coupled inside the plunger body of the plunger. The plunging means is in operational communication with the plunger head and is configured to cause the plunger head to clear a toilet. A plurality of controls is coupled to the plunger body and is in operational communication with the plunging means. A power source is coupled to the plunger body and is in operational communication with, and provides power to, the plunging means.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
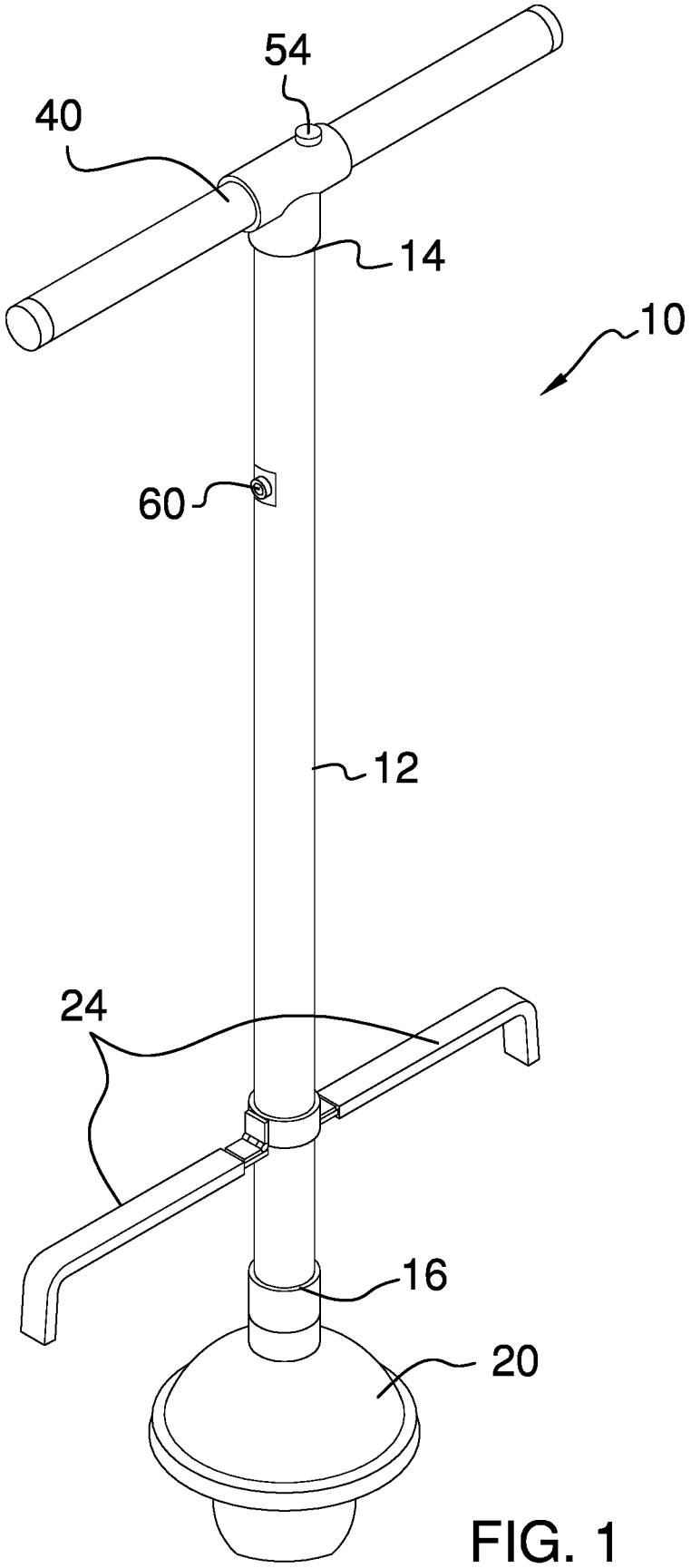
FIG. 1 is an isometric view of an automatic toilet plunger according to an embodiment of the disclosure.
Figure 2:
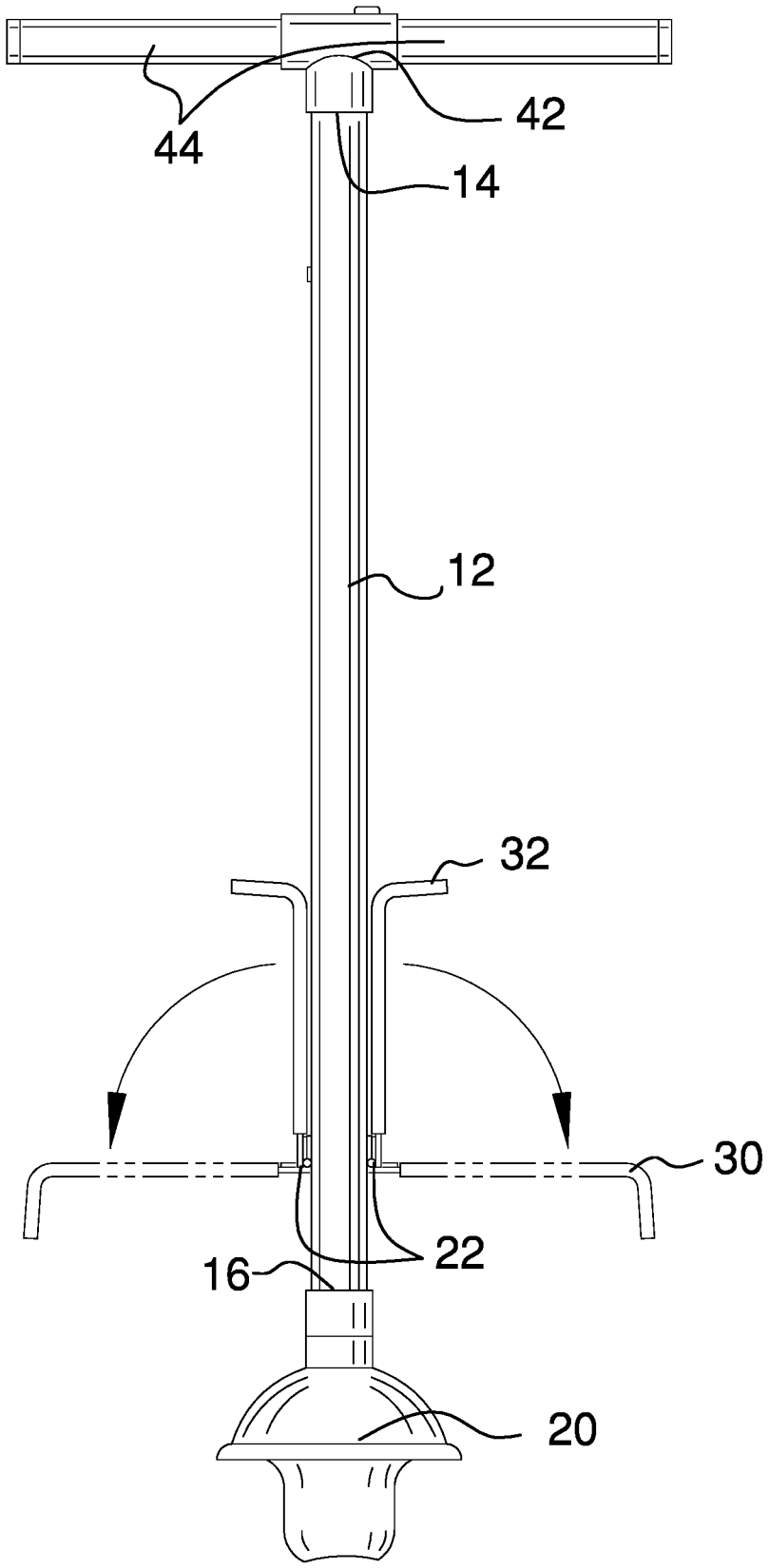
FIG. 2 is a front elevation view of an embodiment of the disclosure.
Figure 3:
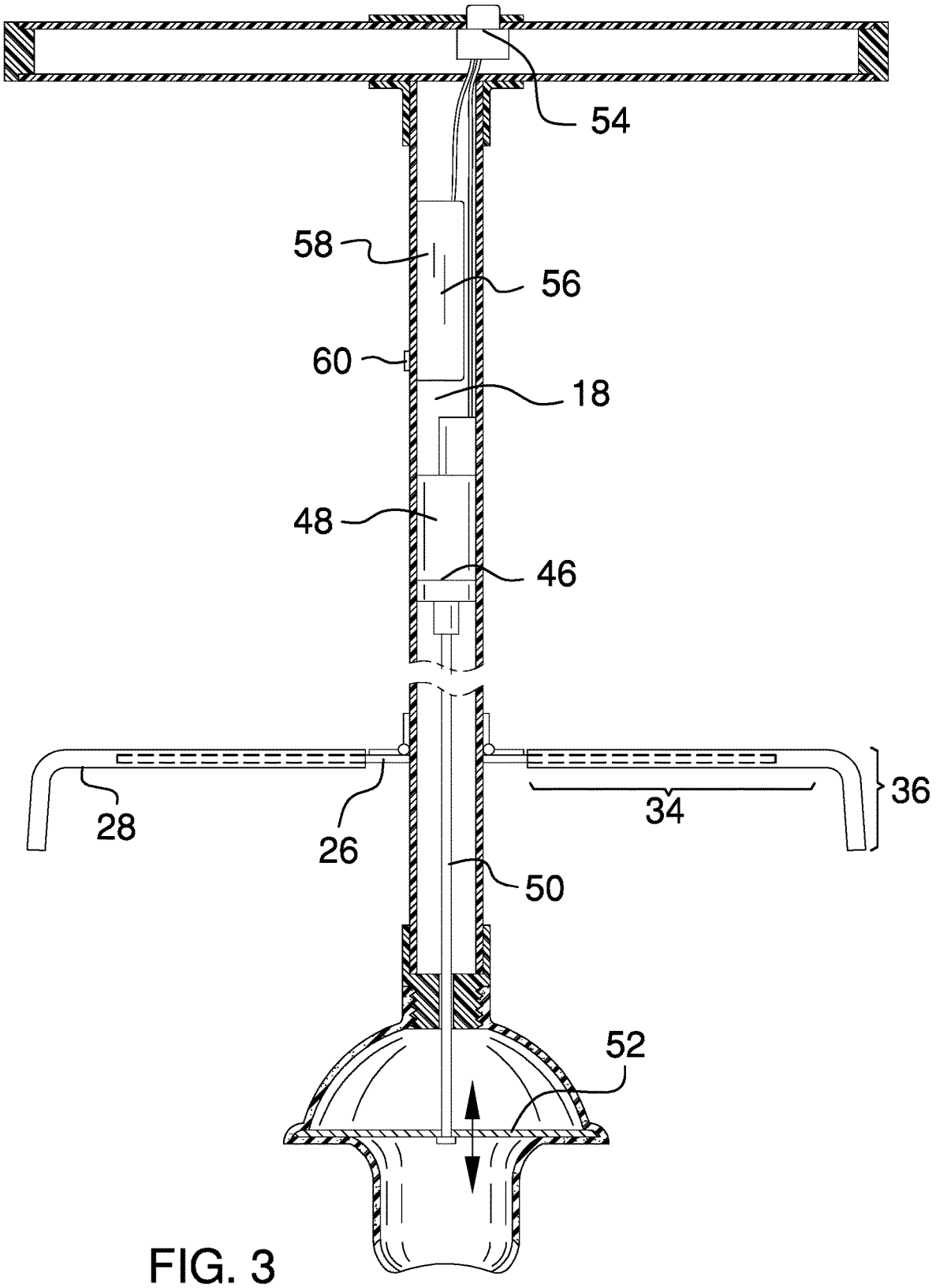
FIG. 3 is a cross-sectional view of an embodiment of the disclosure.
Figure 4:
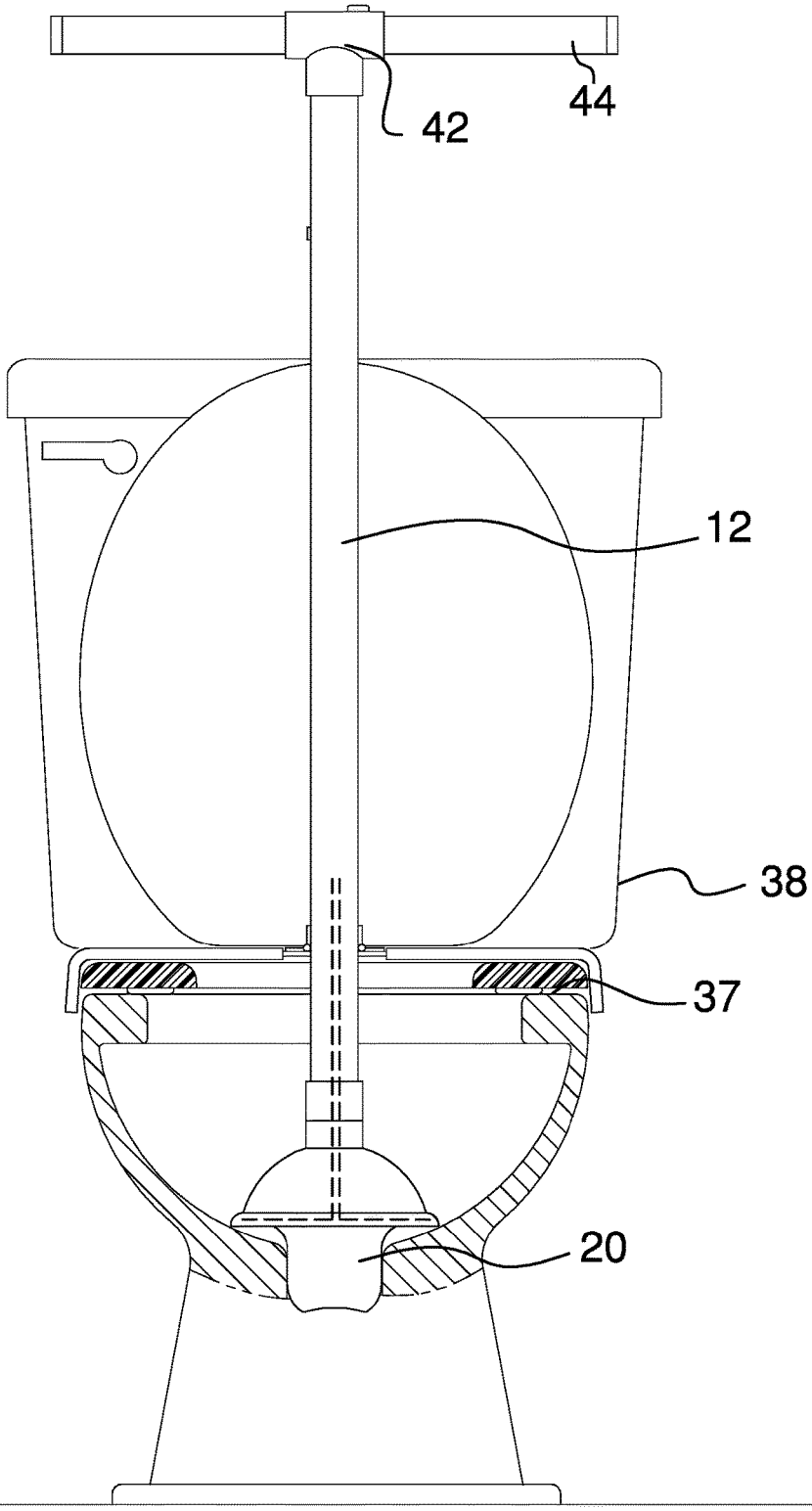
FIG. 4 is an in-use view of an embodiment of the disclosure.

With reference now to the drawings, and in particular to FIGS. 1 through 4 thereof, a new automatically plunge toilets embodying the principles and concepts of an embodiment of the disclosure and generally designated by the reference numeral 10 will be described.

As best illustrated in FIGS. 1 through 4, the automatic toilet plunger 10 generally comprises a plunger body 12 that has a top end 14, a bottom end 16, and an inside 18. The plunger body 12 is hollow and cylindrical. A plunger head 20 is coupled to the bottom end 16 of the plunger body 12. A pair of hinges 22 is coupled to the plunger body 12. A pair of adjustable mounting arms 24 has an extension arm 26 and an engagement hook 28. The extension arm 26 is coupled to the pair of hinges 22. The pair of adjustable mounting arms 24 has an extended position 30 and an alternate folded position 32. The engagement hook 28 is slidably coupled to the extension arm 26. The engagement hook 28 has a straight portion 34 and a bent portion 36. The engagement hook 28 is configured to engage with a rim 37 of a toilet 38. A handle 40 comprising a T-connector 42 is coupled to the to end of the plunger body 12, and a pair of handlebars 44 is coupled to the T-connector 42. A plunging means 46 coupled to the plunger body 12. The plunging means 46 may comprise a linear actuator 48, a reciprocating rod 50, and a plunger plate 52. The plunging means 46 is configured to cause the plunger head 20 to clear the toilet 38. A plurality of controls 54 is coupled to the T-connector 42 of the handle 40 of the plunger body 12. The plurality of controls 54 is in operational communication with the linear actuator 48. A power source 56 is coupled to the plunger body 12. The power source 56 may be a rechargeable battery 58 having a charging port 60 extending through the plunger body 12. The rechargeable battery 58 is in operational communication with, and provides power to, the linear actuator 48.

In use, the plunger body 12 is inserted into the toilet 38 with the engagement hook 28 of the mounting arms 24 engaging the rim 37 of the toilet 38. The plunging means 46 is activated using the plurality of controls 54 to cause the plumber head 20 to clear the toilet 38.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An automatic toilet plunger device comprising:

a plunger body, the plunger body having a top end, a bottom end, and an inside, the plunger body being hollow and cylindrical;

a plunger head coupled to the plunger body, the plunger head being coupled to the bottom end of the plunger body;

a plunging actuator coupled to the plunger, the plunging actuator being coupled within the inside of the plunger body, the plunging actuator being in operational connection with the plunger head such that the plunging actuator is configured to cause the plunger head to clear a toilet when the plunger actuator is manipulated;

a plurality of controls coupled to the plunger body, the plurality of controls being in operational communication with the plunging means;

a power source coupled to the plunger body, the power source being in operational communication with, and providing power to, the plunging actuator; and a pair of adjustable mounting arms coupled to the plunger body, the pair of adjustable mounting arms being configured to engage with a rim of the toilet.

2. An automatic toilet plunger device comprising:

a plunger body, the plunger body having a top end, a bottom end, and an inside, the plunger body being hollow and cylindrical;

a plunger head coupled to the plunger body, the plunger head being coupled to the bottom end of the plunger body;

a plunging actuator coupled to the plunger, the plunging actuator being coupled within the inside of the plunger body, the plunging actuator being in operational connection with the plunger head such that the plunging actuator is configured to cause the plunger head to clear a toilet when the plunger actuator is manipulated;

a plurality of controls coupled to the plunger body, the plurality of controls being in operational communication with the plunging means; and a power source coupled to the plunger body, the power source being in operational communication with, and providing power to, the plunging means; and the plunging actuator comprising a linear actuator, the linear actuator being coupled within the inside of the plunger body, the linear actuator being in operational communication with the plurality of controls and the power source, a reciprocating rod coupled to the linear actuator, the reciprocating rod extending through the bottom end of the plunger body and into the plunger head, and a plunger plate coupled to the reciprocating rod, the plunger plate moving within the plunger head to create suction.

3. The automatic toilet plunger device of claim 1 further comprising the power source being a rechargeable battery, the rechargeable battery having a charging port extending through the plunger body.

4. The automatic toilet plunger device of claim 2 further comprising a handle coupled to the plunger body, the handle comprising a T-connector coupled to the top end of the plunger body and a pair of handlebars coupled to the T-connector, the plurality of controls being coupled to the T-connector.

5. The automatic toilet plunger device of claim 1 further comprising each of the pair of adjustable mounting arms having an extension arm and an engagement hook, the engagement hook being slidably coupled to the extension arm, the engagement hook having a straight portion and a bent portion.

6. The automatic toilet plunger device of claim 5 further comprising a pair of hinges coupled to the plunger body, the extension arm of each of the pair of adjustable mounting arms being coupled to the pair of hinges, the pair of adjustable mounting arms having an extended position and an alternate folded position.

7. An electric toilet plunger device comprising:

a plunger body, the plunger body having a top end, a bottom end, and an inside, the plunger body being hollow and cylindrical;

a plunger head coupled to the plunger body, the plunger head being coupled to the bottom end of the plunger body;

a pair of hinges coupled to the plunger body;

a pair of adjustable mounting arms, each of the pair of adjustable mounting arms having an extension arm and an engagement hook, the extension arm being coupled to the pair of hinges, the pair of adjustable mounting arms having an extended position and an alternate folded position, the engagement hook being slidably coupled to the extension arm, the engagement hook having a straight portion and a bent portion, the engagement hook being configured to engage with a rim of a toilet;

a handle coupled to the plunger body, the handle comprising a T-connector coupled to the top end of the plunger body and a pair of handlebars coupled to the T-connector;

a plunging actuator coupled to the plunger body, the plunging actuator comprising:

a linear actuator, the linear actuator being coupled within the inside of the plunger body, a reciprocating rod coupled to the linear actuator, the reciprocating rod extending through the bottom end of the plunger body and into the plunger head, a plunger plate coupled to the reciprocating rod, the plunger plate moving within the plunger head to create suction, and wherein the plunging actuator is configured to cause the plunger head to clear the toilet;

a plurality of controls coupled to the plunger body, the plurality of controls being coupled to the T-connector of the handle, the plurality of controls being in operational communication with the linear actuator; and a power source coupled to the plunger body, the power source being a rechargeable battery, the rechargeable battery having a charging port extending through the plunger body, the rechargeable battery being in operational connection with, and providing power to, the linear actuator.

* * * * *